United States Patent [19]

Discavage et al.

[11] 3,995,409

[45] Dec. 7, 1976

[54] STRAPPING APPARATUS

[75] Inventors: James L. Discavage, Prospect Park, Pa.; Carl R. Pepmeier, Fredericksburg, Va.

[73] Assignee: FMC Corporation, Philadelphia, Pa.

[22] Filed: May 2, 1975

[21] Appl. No.: 574,059

[52] U.S. Cl. ..... 53/137; 53/198 R; 53/204; 100/26

[51] Int. Cl.[2] ..... B65B 27/06; B65B 61/20

[58] Field of Search ..... 53/128, 137, 156, 198 R, 53/13, 204; 100/26, 33 PB

[56] References Cited

UNITED STATES PATENTS

| | | | |
|---|---|---|---|
| 2,597,675 | 5/1952 | Sackett | 100/26 |
| 2,707,429 | 5/1955 | Leslie et al. | 100/26 X |
| 3,271,925 | 9/1966 | Aubrey | 53/198 X |
| 3,759,169 | 9/1973 | Goodley | 100/33 PB X |

*Primary Examiner*—Travis S. McGehee
*Assistant Examiner*—J. Sipos

[57] ABSTRACT

A strapping apparatus which includes a yoke for directing a strap about a package which is to be strapped, and means for delivering and positioning a package reinforcing or protective plate along a portion of such package which is located in the area at which the applied strap is to be sealed. The yoke of this apparatus includes a retractable section which provides for greater flexibility in the placement of packages in strapping position and, also, facilitates the strapping of a variety of packages of different shapes, such as annular packages or packages of coiled materials.

10 Claims, 12 Drawing Figures

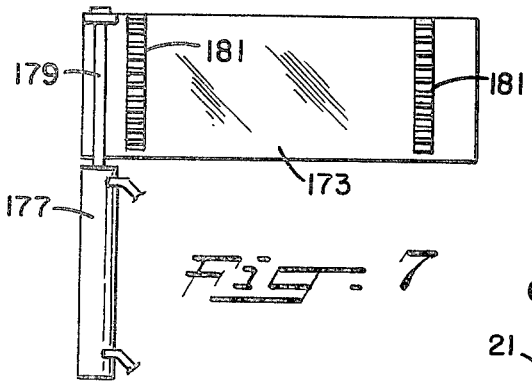
Fig. 7
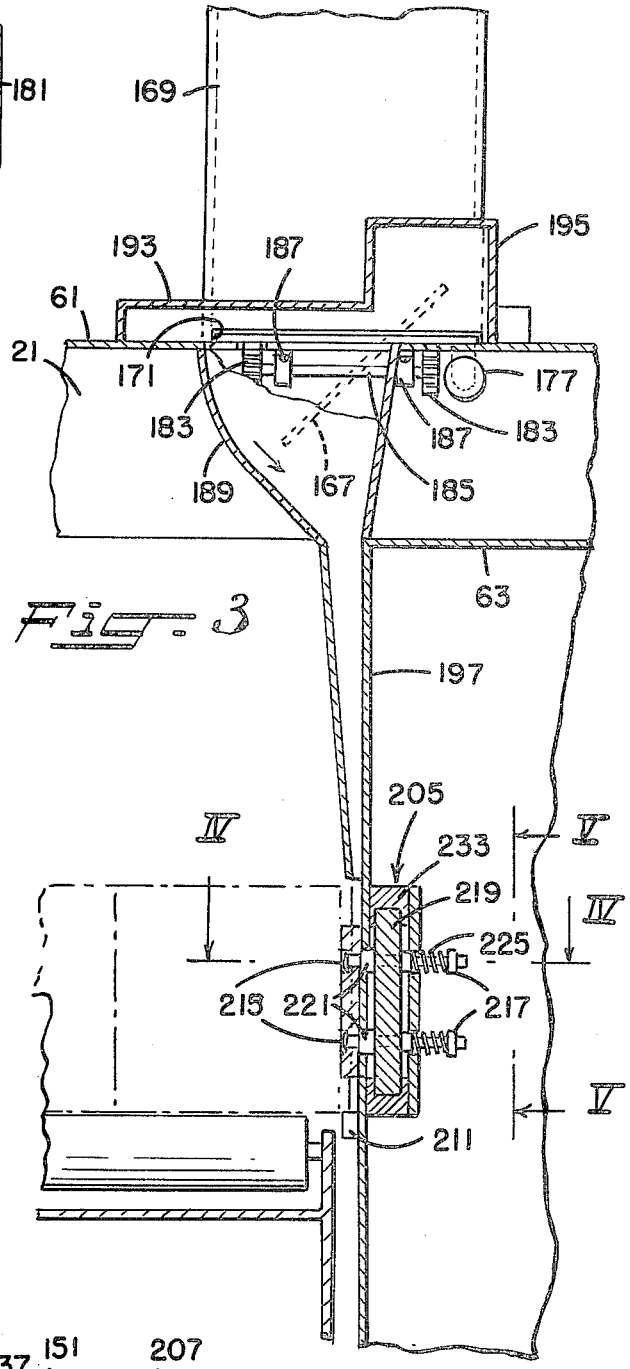
Fig. 3
Fig. 5
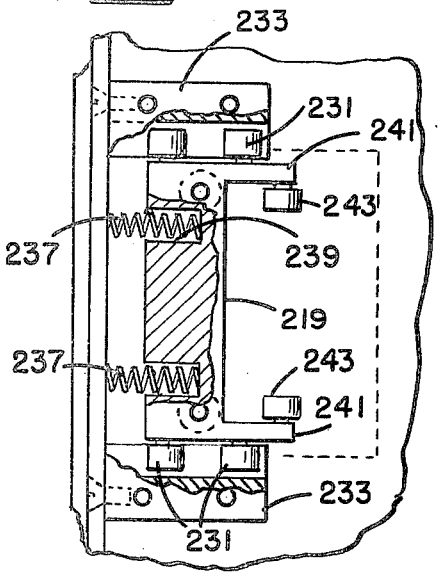
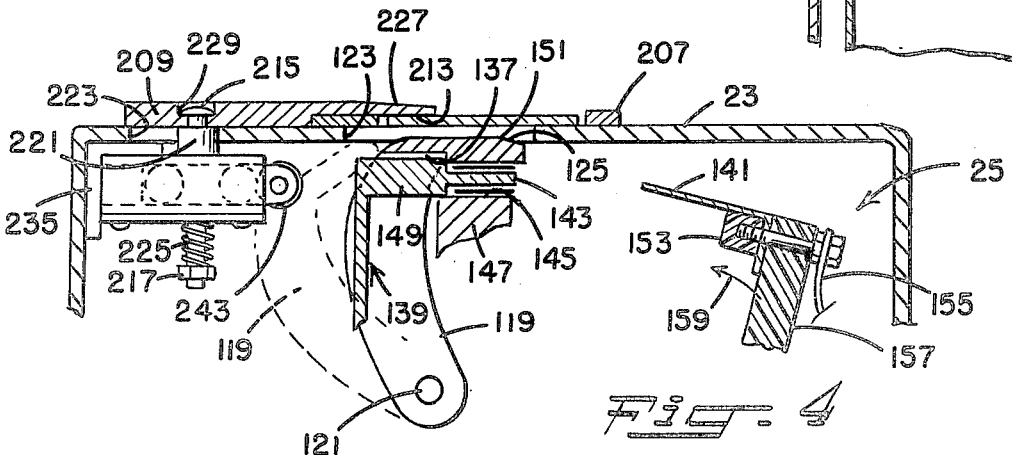
Fig. 4

STRAPPING APPARATUS

The present invention is directed to an improved apparatus for strapping packages with heat sealable plastic strap.

The apparatus of this invention is an improvement over that disclosed in U.S. Pat. No. 3,759,169 issued to G. F. Goodley. Portions of the apparatus disclosed in this Goodley patent are included in the apparatus of the present invention and thus the patent to Goodley U.S. Pat. No. 3,759,169 is incorporated herein by reference.

A primary object of this invention is to provide a generally improved and more satisfactory package strapping apparatus.

Another object of this invention is the provision of an improved strapping apparatus having a retractable yoke section which permits the apparatus to accommodate packages of various sizes and shapes.

Still another object is to provide an improved strapping apparatus which is adapted to apply reinforcing or protective members to packages.

A further object is the provision of an improved strapping apparatus which is adapted to automatically deliver and position a package protective or reinforcing member along one side and at a location at which strapping is to be applied to such package.

A still further object of this invention is to provide a strapping apparatus in which a package reinforcing or protective plate is delivered along one side of a package which is to be strapped, with the plate delivery being dependent upon and correlated with the strapping operation itself.

These and other objects are accomplished in accordance with the present invention by a strapping apparatus in which a yoke, disposed in a plane extending at an angle and intersecting with the plane of a package support, includes a movable section which is reciprocable in the plane of such yoke between a retracted position, in which it is spaced from the package support, and a projected position, in which such yoke section intersects with the plane of the package support. Incorporated into this apparatus from the teachings of the United States patent to Goodley U.S. Pat. No. 3,759,169 are means for feeding a strap along the yoke and into position in which its leading end portion is overlapped by a trailing portion; means for gripping the leading end portion of the strap after the feeding thereof along the yoke; means for tensioning the strap about a package on the support after the strap leading end portion is gripped; and means, including a retractable anvil, for heat sealing the leading end portion of the strap to an overlapping trailing portion thereof.

Departing from the teachings of the Goodley U.S. Pat. No. 3,759,169, the apparatus of the present invention includes means for positioning a generally flat reinforcing member in alignment with the yoke and in position to be strapped to the package carried by the package support. This positioning means cooperates well with the remainder of the apparatus by delivering and holding individual of such reinforcing members along one side of the package which is to be strapped and within the area at which the applied strap is to be sealed.

More particularly, the fixed section of the yoke includes a wall which extends across the plane of the yoke and has an opening therein. Aligned with such opening are the strap gripping and sealing means, which are located outwardly of the yoke, and means, located within the yoke, for releasably holding a reinforcing member. This holding means is comprised of an abutment secured to the wall of the yoke fixed section along one side of the opening therein, and a retainer plate disposed along the opposite side of such wall opening and being movable to and from an operative position in which such plate partially covers the wall opening. In its operative position the retainer plate cooperates with the abutment to hold a reinforcing member adjacent to the opening in the wall of the yoke fixed section and, upon movement from such operative position, permits the reinforcing member to be removed with the strapped package.

The retainer plate is normally maintained in its operative position under the influence of resilient means and is moved away from such operative position by the anvil of the strap sealing means as it itself is retracted from an operative position adjacent to the opening in the wall of the fixed yoke section.

Included as part of the reinforcing member positioning means is a magazine, which is supported above the yoke and laterally of its plane, and which is adapted to contain a plurality of such reinforcing members in stacked relationship. Individual of such reinforcing members are dispensed from the magazine by a reciprocating plate which serves to push the lowermost of the stacked members along the magazine support and over an opening therein. Aligned at one end with such opening and at its opposite end with the holding means is a guide which serves to orient the individual of the reinforcing members during their travel by gravity, for proper reception by the holding means. Assisting in this respect is the opening in the magazine support, which is dimensioned so that a reinforcing member which is moved over such opening is caused to tilt and thereby move from a flat toward an upright position.

The terms "strapping" and "strap" as employed herein have a common meaning and are intended to include conventional generally flat, narrow, elongated flexible structures which are formed of synthetic thermoplastic materials, such as, polypropylene, nylon and polyesters, and which have been stretched in the longitudinal direction to uniaxially orient the molecules thereof.

The apparatus of the present invention is adapted for use in strapping "packages" or "articles" of various configuration and thus these terms are used interchangeably and are not limited to any particular product or products or structure having a specific shape.

Similarly, reference made to "reinforcing" member or plate is intended to include structures which serve to impart some degree of rigidity to the strapped package at the location at which a strap is applied as well as structures which primarily serve to protect the strapped package at the location at which such strap is applied. Such reinforcing members are preferably of thin, rectangular configuration.

In the drawing, FIG. 1 is a side view of the apparatus of the present invention;

FIG. 3 is a vertical section taken along the line III—III of FIG. 2;

FIG. 4 is a horizontal section taken along the line IV—IV of FIG. 3;

FIG. 5 is a view taken along the line V—V of FIG. 3, with a portion of the structure being broken away to better illustrate details thereof;

FIG. 7 is a bottom view of an element of the apparatus shown in FIGS. 1 and 3;

Figure 1:
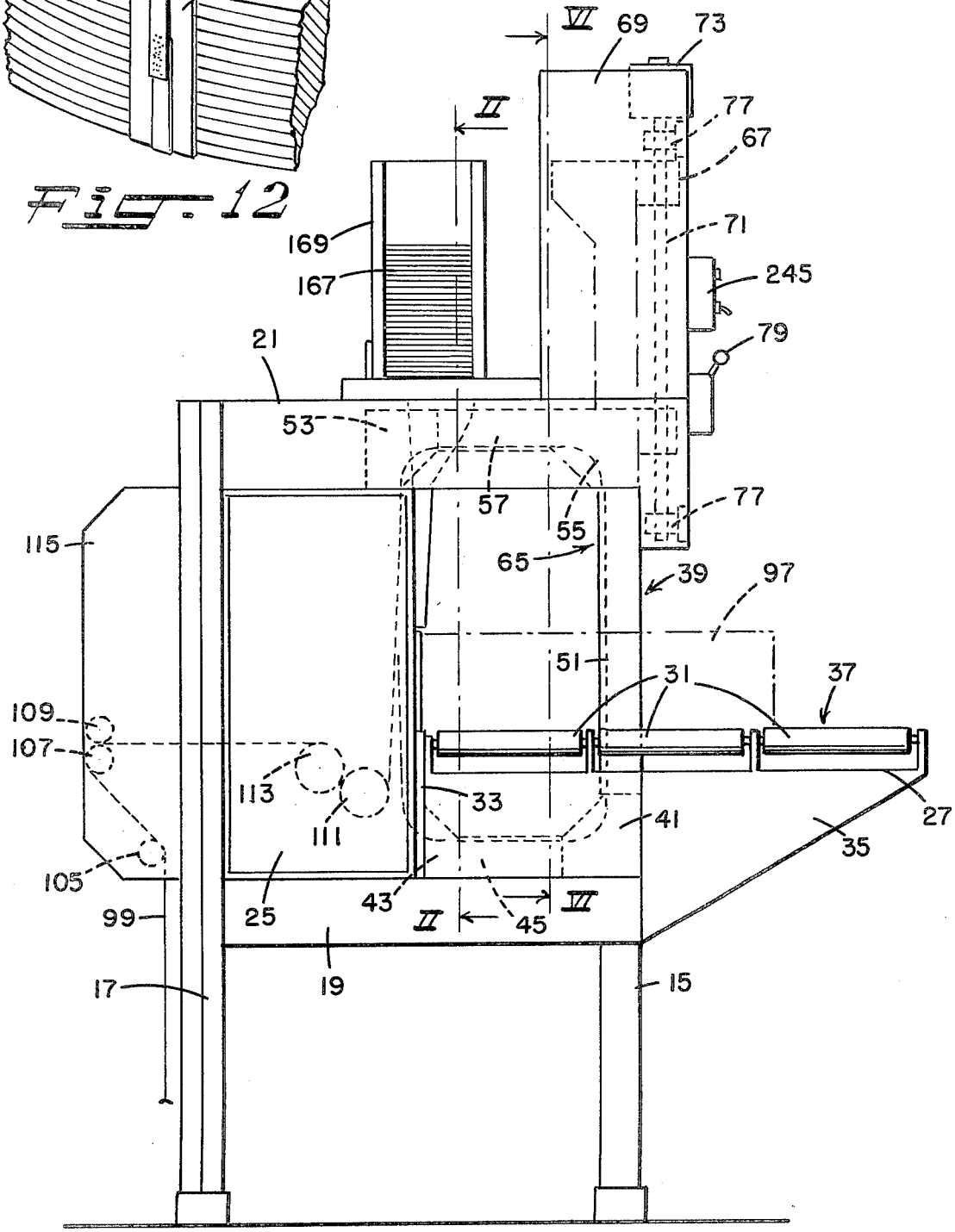
Figure 2:
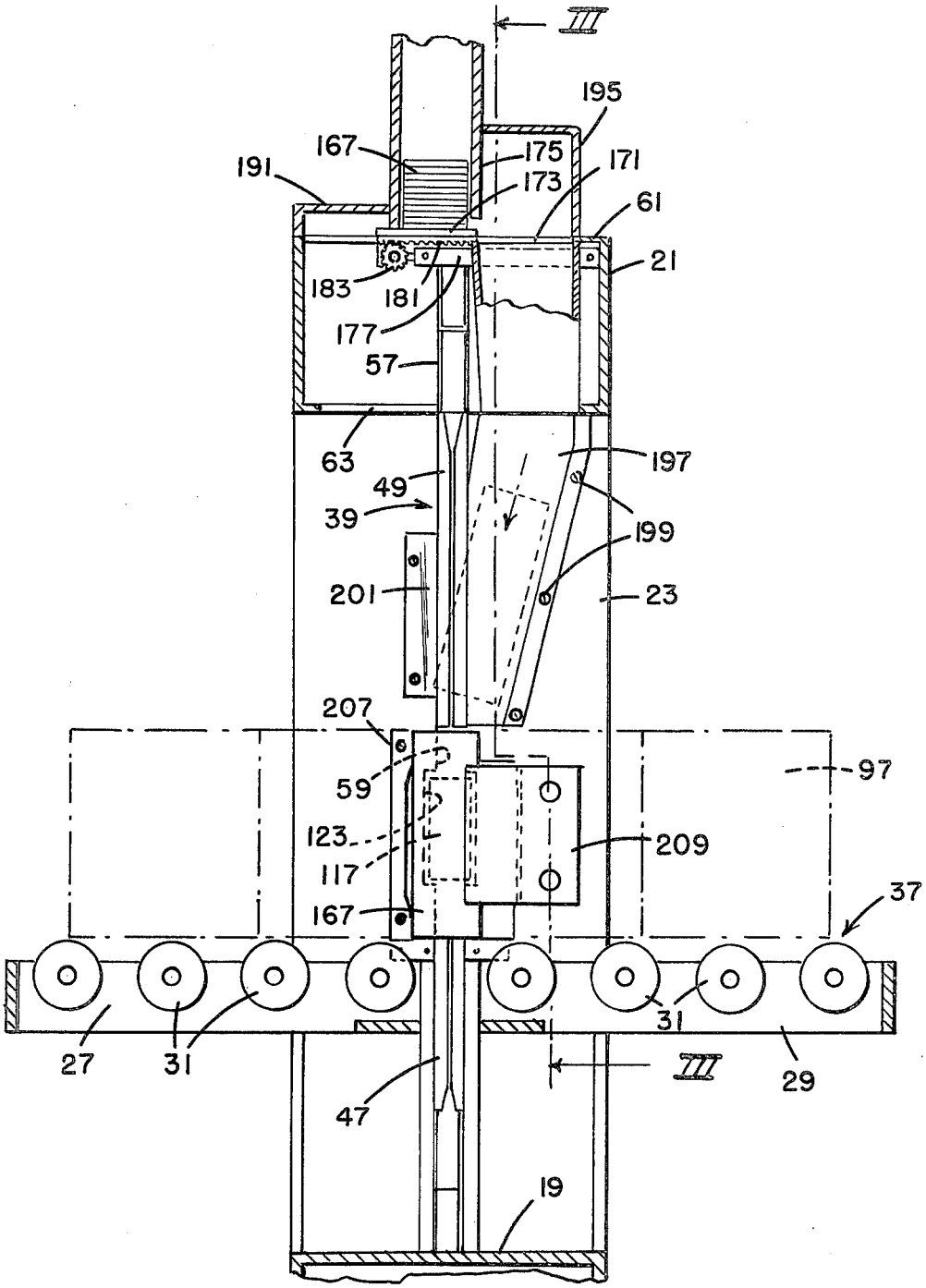
FIG. 2 is a vertical section taken along the line II—II of FIG. 1.

With reference to FIGS. 1 and 2 of the drawing, the strapping apparatus of the present invention includes a supporting framework comprised of uprights 15 and 17, a lower box beam 19, an upper box beam 21 and a plate 23 which assists the upright 17 in supporting the box beam 21 and forms one wall of a housing 25. A pair of rectangular frames 27 and 29, each having rows of idler rollers 31, are supported from the lower box beam 19 by plates 33 and brackets 35 and together such frames 27 and 29 provide a generally horizontal article support, which is designated by the character 37.

Figure 6:
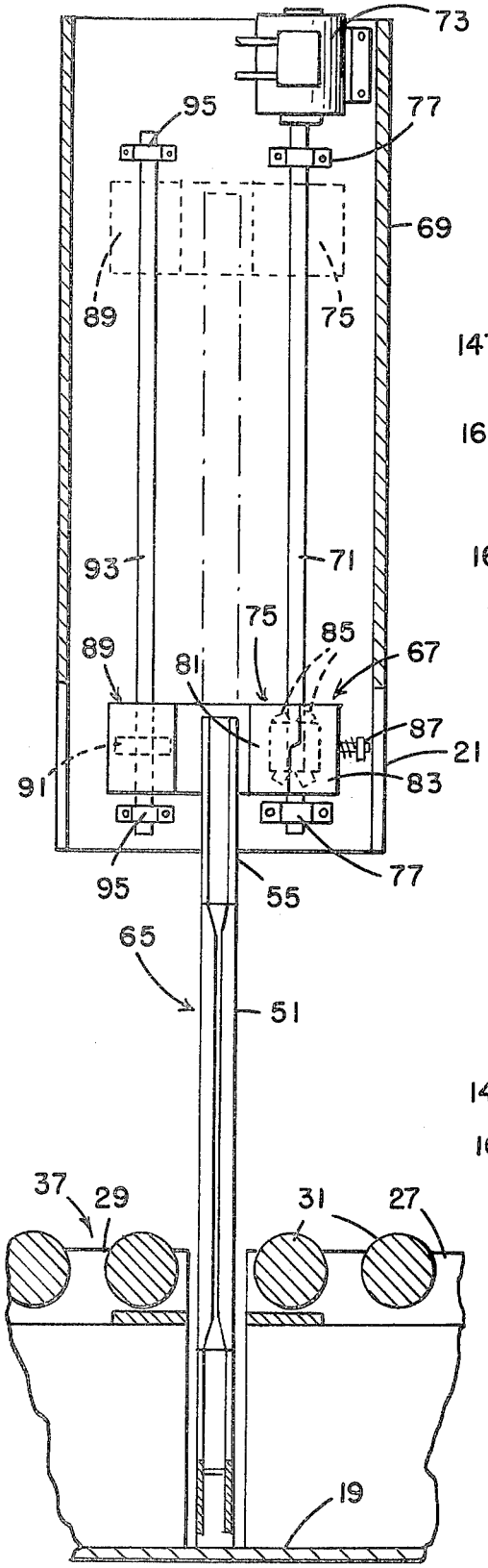
FIG. 6 is a vertical section taken along the line VI—VI of FIG. 1.
Figure 11:
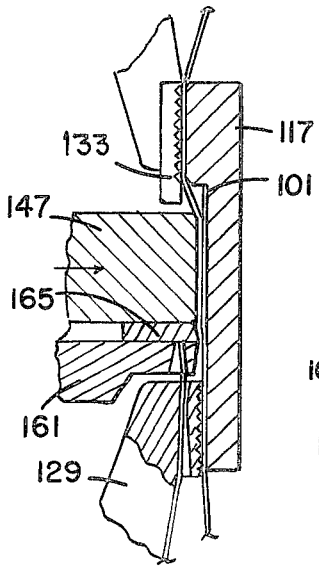
FIGS. 8, 9, 10 and 11 are fragmentary views which illustrate the relationship of elements of the apparatus during a sequence of operations.

As shown in FIGS. 2 and 6, the frames 27 and 29 are spaced laterally from each other to accommodate a portion of an article receiving yoke 39 and, as will be more apparent hereafter, to permit a strap to be applied to an article resting on the support 37.

Except as hereafter described, the yoke 39 is of a construction as disclosed in the above noted U.S. Pat. No. 3,759,169 to Goodley and as shown in FIGS. 1, 2 and 6, includes lower angle brackets 41 and 43, a lower horizontal leg 45, longitudinally spaced vertical legs 47 and 49, a continuous vertical leg 51, upper angle brackets 53 and 55 and an upper horizontal leg 57. All of these yoke elements are aligned to provide a continuous passage for a strapping and are disposed in a common plane which, in the apparatus illustrated, is substantially vertical and intersects the plane of the article support 37.

More particularly, the lower angle brackets 41 and 43 and the horizontal leg 45 are fixed to the lower box beam 19, while the longitudinally spaced vertical legs 47 and 49 are mounted within the housing 25 in alignment with a vertical slot 59 formed in the housing wall 23. As shown in FIGS. 2, 3 and 6, top and bottom walls 61 and 63 of the top box beam 21 terminate short of its free end to accommodate the yoke upper angle brackets 53 and 55 and upper horizontal leg 57, as well as other elements hereafter described. The yoke angle bracket 53 and horizontal leg 57 are fixed to the box beam 21, while the angle bracket 55 and the yoke continuous leg 51 are connected and together constitute a movable yoke section 65 which is adapted to be reciprocated within the plane of the yoke 39.

The details of construction of the angle brackets 41, 43, 53 and 55 and legs 45, 47, 49, 51 and 55 of the yoke 39 correspond with that of the yoke described in the above noted patent to Goodley U.S. Pat. No. 3,759,169.

Reciprocation of the movable yoke section 65 between its solid and broken line positions shown in FIG. 1 can be achieved with a variety of conventional mechanisms, as for example, a pneumatic cylinder, rack and pinion, chain and sprockets and belt and pulleys. Admirably suited for this function, and illustrated in the drawing, is a Roh'lix (Registered Trademark) actuator system which is described in U.S. Pat. No. 3,272,021 and is commercially available from the Barry Wright Corp., Watertown, Massachusetts and Burbank, California.

The above identified actuator system is indicated at 67 and is disposed within a housing 69 which is carried by the upper box beam 21 and extends across and below its free end. Basically, the system 67 consists of a threadless drive shaft 71, which is rotated by an air motor 73, and a linear actuator 75 which is fixed to the movable yoke section 65. Bearings 77 support the shaft 71 for rotary movement and the operation of the air motor 71 is controlled by a two position toggle valve 79.

Described briefly, the linear actuator 75 is comprised of two sections 81 and 83 and contains three free-wheeling rollers 85 at each end which are angled relative to the axis of the shaft 71 and spring loaded against such shaft by means as indicated at 87. Thus, as the shaft 71 is rotated, the rollers 85 describe a helical path along such shaft, with the linear actuator 75 being elevated or lowered to retract or project the yoke section 65.

The speed at which the actuator travels is governed by the rate of rotation of the shaft 71 and the lead of the angled rollers 85, while the thrust developed is dependent upon the force exerted on the drive shaft 71 by such rollers 85. This thrust force is governed and can be varied by the spring means 87. Significant from the standpoint of safety is that resistance encountered by the actuator 75, or the yoke section 65 carried thereby, which is greater than the preset thrust force simply causes the actuator to free wheel until such resistance is removed. An actuator system 67 having a lead of 0.200 inches per revolution and a maximum thrust of about 30 pounds has proven satisfactory in the apparatus of the present invention but, of course, system 67 having other lead and thrust characteristics can be employed with equally satisfactory results.

Support for the movable yoke section 65 during its reciprocating movements is provided by a carriage 89, having linear ball bearings 91, which ride along a stationary rod 93 fixed at 95 to the housing 69.

The presence of the movable yoke section 65 renders the apparatus of the present invention rather flexible and adapts the same for strapping of a variety of articles. For example, with the yoke section 65 in its lowermost position, elongated articles, such as a group rods or pipes, may be advanced longitudinally through the yoke 39 into a strapping position. Alternatively, the yoke section 65 may be elevated, permitting such elongated articles to be advanced along the support 37, parallel to the axis of the rollers 31, and directly into strapping position. Moreover, this apparatus is ideally suited for applying strap radially about annular packages, such coils of hose, wire, rope, and the like, and, for purposes of description, a coil of strapping 97 is illustrated by broken lines in FIGS. 1–3 in position for strap application.

With the movable yoke section 65 in its projected or lowermost position, a plastic strap 99 is delivered longitudinally from a supply source, not shown and along the yoke 39, as illustrated by broken lines in FIG. 1, to locate its leading end 101 in overlapping relationship with a trailing portion thereof. As will be more fully described hereafter, the leading end 101 of the strap 99 is then gripped, the delivered strap is retracted so as to be withdrawn from the yoke 39 and tensioned about the coil 97, afterwhich its trailing portion is gripped, severed and sealed by bonding the trailing and leading strap ends together.

While some description is hereafter provided of the strap delivery or transport, tensioning, gripping, cutting and sealing means it will be understood that such mechanisms are essentially the same in both construction and operation as is described in detail in the Goodley U.S. Pat. No. 3,759,169.

Portions of the strap transport mechanism is diagrammatically illustrated in FIG. 1 and includes guide rollers 105, 107 and 109 and cooperating strap feed and tension wheels 111 and 113. The guide rollers 105, 107 and 109 are located between plates 115 which are supported by the structural framework in spaced relationship which is slightly greater than the width of the strap 99. The feed and tension wheels 111 and 113 are located within the housing 25, with a suitable opening being provided in the upright 17 to facilitate passage of such strap.

Shown in FIGS. 4 and 8–11 are other of the above mentioned mechanisms which are incorporated into the apparatus of the present invention from the Goodley U.S. Pat. No. 3,759,169. More specifically, an anvil 117 is mounted for side retraction by means of side arms 119 which are rotatably carried by pivot bolts 121. In its operative position, as hereafter described, the anvil 117 is located opposite to an opening 123 which is aligned with the slot 59 in the housing wall 23, as seen in FIG. 2.

The anvil 117 has a beveled nose 125, an inner surface 127, which cooperates with a lower gripper 129, and an offset surface 131 for cooperating with an upper gripper 133. A shoulder 135, connecting the surfaces 127 and 131, serves as a stop for arresting the leading end 101 of the strap 99 during its advancement along the yoke 39.

Figure 10:
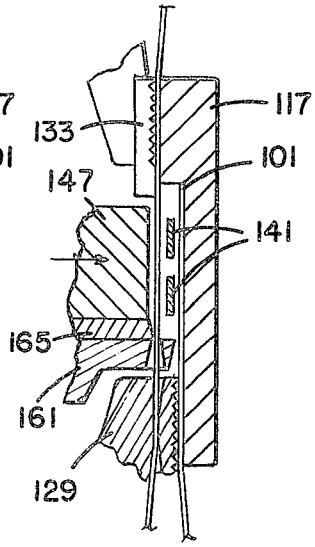
Figure 9:
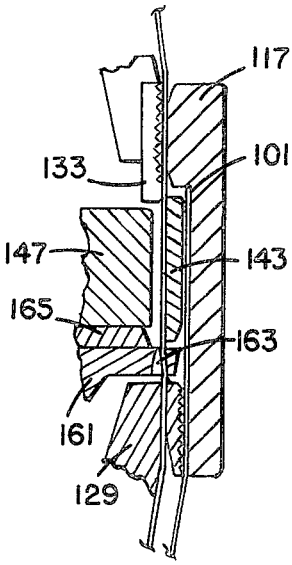
Figure 8:
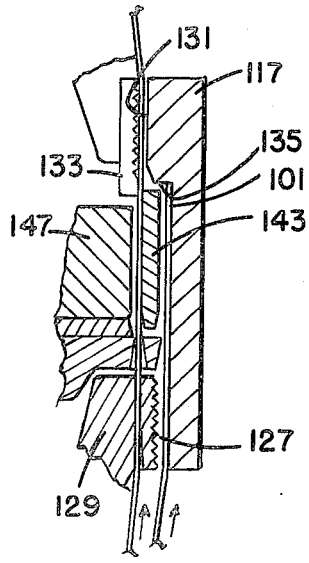

The anvil 117 is notched at 137 to receive a portion of a tongue 139 which serves as a retractable guide between the leading end 101 of the strap 99 and the bight of such strap, as seen in FIGS. 4, 8 and 9. This tongue 139 is also mounted on the pivot bolts 121 and is retractable so that a heated sealing blade 141 can be inserted in the space previously occupied by the tongue 139, as seen in FIG. 10.

As shown in FIGS. 4, 8 and 9, the tongue 139 has a thin terminal flange 143 which, when the tongue is in its projected position, lies adjacent to but spaced from the anvil surface 127 and a surface 145 of a platen 147 to provide two spaces for the passing strap. This flange 143 is joined to a thicker portion 149 in a manner as to form shoulders 151 for engaging a complementary shoulder formed by the notch 137 on the anvil 117 so that upon retraction of the anvil 117 the tongue 139 is also retracted.

The heat sealing blade 141 is a thin, sinuous resistance element mounted on an insulator 153 and connected across to power supply leads 155. An arm 157 supports the blade 141 and is pivoted for swinging movement as indicated by the arrow 159 in FIG. 4.

The platen 147 is movable toward the anvil 117, first to squeeze the strap parts against the sealing blade 141, and then to squeeze the heated joint after retraction of such blade to make the seal. This platen 147 slides in a housing, not shown, to which is fixed a shear plate 161 that is apertured at 163 to permit passage of the strap 99 to the yoke 39. A knife 165 is fixed to the platen 147 and cooperates with the shear plate 161 to cut the strap 99 during movement of such platen 147 toward the anvil 117.

Incorporated also in the apparatus of the present invention are means for delivering a reinforcing plate 167 along one side of the article or package which is to be strapped. This plate may be formed of any suitable material which satisfies the desired reinforcing or protective function and may be, for example, stiff cardboard, wood, asbestos, plastic or metal. Satisfactory results in strapping of packages or coils of strapping have been achieved using plates 167 formed of pressed, bonded particle board such as "Masonite" (Registered Trademark).

The plates 167 are dispensed in a desired sequence, correlated with the strapping operation, and are positioned along the side of the article or package being strapped within that area at which the strap end portions are to be sealed. As shown in FIGS. 1–3, a series of such plates 167 are stacked within a magazine 169 which is supported by the box beam 21 directly adjacent to an opening 171 in its top wall 61. This stack of plates 167 rests upon a pusher plate 173 which, in turn, is carried by the wall 61. As seen in FIG. 2, one side wall 175 of the magazine 169 terminates above the upper surface of the pusher plate 173 a distance slightly greater than the thickness of one such plate 167.

The pusher plate 173 is adapted to be moved toward and is away from its operative position shown in FIG. 2 by an air cylinder 177 having supply and exhaust lines, a piston, not shown, and a piston rod 179 which is attached to the underside of the plate 173. Support of the pusher plate 173 is provided by the top wall 61 of the box beam 21 and skewing of such plate 173 during its reciprocating movement is avoided by racks 181 which are fixed to its lower surface and mesh with pinions 183 carried by a shaft 185. Bearings 187 rotatably support the shaft 185 and are fixed to the inner surface of the beam top wall 61.

Upon retraction of the pusher plate 173; that is to the left as viewed in FIG. 2, the stack of plates 167 drops onto and is supported on the upper wall 61 of the beam 21. During projection of such pusher plate 173 into its position shown in FIG. 2, the lowermost of the plates 167 is advanced along the beam upper wall 61 and toward the beam opening 171. As shown in FIG. 3, the beam opening 171 is generally aligned at one end with the magazine 169 and spans more than one-half of the length of a plate 167. Thus, as the plate 167 is disposed over such opening 171, it automatically tilts in its lengthwise direction from a flat and toward an upright position as it enters into a drop chute 189. As shown in FIGS. 2 and 3, protective hoods 191 and 193 are provided above the path of the pusher plate 173 and the opening 171, with the hood 193 having an upwardly projecting section 195 to accommodate the tiliting of the individual plates 167 as they enter the chute 189.

The drop chute 189 is, of course, aligned with the opening 171, extends to the bottom wall 63 of the beam 21 and opens into a positioning chute 197 which is fastened at 199 to the housing wall 23. As seen in FIG. 2, the chute 197 is angled to direct the plate 167 laterally toward the center of the housing wall 23. A deflector 201, also fixed to the housing wall 23, cooperates with the chute 197 to swing the plate 167 during its downward travel so as to align its longitudinal axis with the yoke legs 47 and 49. Thus, the chutes 189 and 197 and the deflector 201 together cooperate to guide the individual plates 167 during their travel under the force of gravity and also to orient such plates 167 into position for proper reception by a holding means indicated at 205.

The holding means 205 serves to locate and maintain the individual plates 167 along one side of the package 97 which is to be strapped and in alignment with the opening 123 in the housing wall 23. Comprising this holding means 205 is an abutment 207, a retainer plate 209 and a projection or ledge 211, all of which are carried by the housing wall 23. The top surface of the ledge 211 is substantially coplaner with the package support 37 and aligns the plate 167 in its vertical direction with the opening 123 in the housing wall 23, while the abutment 207 and retainer plate 209 together align the plate 167 in its transverse direction with such opening 123.

As illustrated in FIGS. 3–5, the retainer plate 209 is recessed at 213 for reception of a reinforcing plate 167 and is connected by bolts 215 and nuts 217 to an actuator plate 219 which is located within the housing 25. Bushings 221 are disposed between the retainer and actuator plates 209 and 219 and are adapted to ride along horizontal slots 223 formed in the housing wall 23. In addition, springs 225 are interposed between the nuts 217 and the actuator plate 219, and thus the retainer plate 209 is held snugly, yet yieldably, against the housing wall 23 to facilitate movement thereof in its plane away from its operating position shown in FIG. 4. Further, it will be noted that the outer surface of the retainer plate 209 is tapered at 227 and recessed at 229, for reception of the heads of the bolts 215, to thereby permit placement of the package 97 close to the reinforcing plate 167 and to avoid damage to such package.

The actuator plate 219 is mounted for movement in a direction substantially parallel to the housing wall 23 by rollers 231 which project from its opposite ends and are received with channels 233 carried by a housing bracket 235. Normally, the retainer plate 209 is urged into its operative position shown in FIG. 4 by springs 237 which are seated within recesses 239 in the actuator plate 219 and bear against the housing bracket 235. A pair of arms 241, having rollers 243 at their free ends, project from the actuator plate 219 and into the path of the anvil 117. Thus, as the anvil 117 is retracted from its operative position opposite the housing opening 123, the retainer plate 209 is also retraced against the resilient force of the springs 237.

In the operation of the described apparatus, the toggle valve 79 is first actuated to effect elevation of the movable yoke section 65, the coil package 97 is positioned and the valve 79 is then manipulated to project the yoke section 65 into and through the central opening of such coil package 97. An on-off valve 245 sets the appartus into operation in the same manner as described in the above noted U.S. Pat. No. 3,759,169 to Goodely and, in addition, operates the air cylinder 177 to effect the dispensing of a reinforcing plate 167. More particularly, as the on-off valve 245 is manipulated, the pusher plate 173 is first retracted until the lowermost of the plates 167 in the magazine 169 falls onto the beam wall 61, and then projected to urge such plate 167 toward the beam opening 171. Once over such opening 171, the plate 167 tilts, and during its downward travel by gravity relative to the chutes 189 and 197 and deflector 201, it is guided and oriented for proper reception by the holding means 205, as shown in FIGS. 2–4.

Concomitantly with the delivery of the reinforcing plate 167, the feed wheel 111 advances the strap 99 along the yoke 39 until its free end 101 strikes the stop 135 on the anvil 117, as shown in FIG. 8. As more fully described in the Goodley U.S. Pat. No. 3,759,169, the lower gripper 129 holds the strap 99 against the anvil surface 127 (FIG. 9) and the tension wheel 113 is turned to retract the strap 99, withdrawing the same from the yoke 65 and tensioning the same about the package 97. As seen in FIGS. 2 and 6, the spaced relationship of the package support frames 27 and 29, and the slot 59 in the housing wall 23, permit the strap 99 to be tensioned about the package 97.

With reference to FIGS. 2–11, the gripper 133 then presses the strap 99 against the anvil surface 131, (FIG. 9); the tongue 143 is retracted and the heated blade 144 assumes its position between the overlying strap portions (FIG. 10); and the platen 147 is moved toward the anvil 117. During this movement, the knife 165 coacts with the shear plate 161 to serve the strap 99 and then urge the same against the heated blade 141. Upon retraction of each blade 141, the platen 147 continues to press the now contacting, overlapped strap portions against the anvil 117. Once the sealed strap joint has been adequately cooled, the platen 147 and the anvil 117 are retracted, with the latter urging the actuator plate 219 against the resilient action of the springs 237 and thereby retracting the retainer plate 209.

Figure 12:
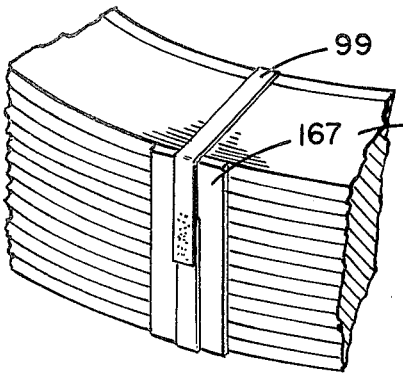
FIG. 12 is a diagrammatic illustration showing a portion of a package which has been strapped with the apparatus of the present invention.

The yoke section 65 may be then elevated to permit removal of the strapped package 97, or such package may be simply turned about its axis to orient the same into position for application of additional strapping at another location. As seen in FIG. 12, the plate 167 is held snugly against the side of the package 97. Thus, the plate 167 provides the necessary rigidity to the package 97 as to avoid package distortion, as by displacement of coil windings, during the actual strapping operation and continues to serve such function during subsequent handling and transit of the strapped packages.

It is to be understood that changes and variations may be made without departing from the spirit and scope of the invention as defined in the appended claims.

We claim:

1. A package strapping apparatus including a package support disposed in one plane, a package receiving yoke disposed in a plane extending at an angle to and intersecting with the plane of said support, said yoke having a fixed section and a movable section with the movable yoke section being adapted to extend through the plane of said support, means for positioning a flat package reinforcing member within said yoke, adjacent to said support and said yoke fixed section and in a plane which intersects with both the plane of said support and the plane of said yoke whereby the flat reinforcing member is in position to be strapped to a package on said support, means for feeding a strap along said yoke and into position in which its leading end portion is overlapped by a trailing portion thereof, means for gripping the leading end portion of the strap after the feeding thereof along said yoke, means for tensioning the strap about the package on said support after the leading end portion thereof is gripped, means for sealing said leading end portion of the strap to an overlapping trailing portion thereof, and means for reciprocating said movable yoke section in the plane of said yoke between a retracted position, in which such movable yoke section is spaced from said support, and a projected position in which such movable yoke section extends through the plane of said support.

2. Apparatus as defined in claim 1 wherein said fixed yoke section includes a wall extending across the plane of said yoke and having an opening therein, said strap gripping and sealing means being located outwardly of said yoke and in alignment with the opening in the wall of said fixed yoke section, and wherein said positioning means includes means for releasably holding an individual reinforcing member in a plane substantially parallel to said wall and generally opposite to the opening therein.

3. Apparatus as defined in claim 2 wherein said holding means includes an abutment fixed to said wall along one side of the opening therein, a movable retainer plate disposed along an opposite side of said wall opening and means for moving said retainer plate to and from an operative position in which said retainer plate partially overlaps the opening in said wall, said retainer plate in its operative position cooperating with said abutment to hold a reinforcing member adjacent to said wall opening and in its inoperative position permitting removal of the reinforcing member with the strapped package.

4. Apparatus as defined in claim 3 wherein said retainer plate is movable in its plane and includes resilient means normally urging the same into its operative position.

5. Apparatus as defined in claim 4 wherein said sealing means includes an anvil and means for moving said anvil to and away from an operative position in alignment with said wall opening, and wherein said means for moving said retainer plate from operative position includes means carried by said retainer plate and projecting into the path of said anvil for engagement therewith during its retraction from operative position.

6. Apparatus as defined in claim 2 wherein said positioning means includes a magazine, means for supporting said magazine at an elevated position relative to said holding means and means for guiding a reinforcing member to said holding means as it travels by gravity from said magazine.

7. Apparatus as defined in claim 6 wherein said magazine supporting means is located above said yoke, an opening extending through said magazine supporting means at a location laterally of the plane of said yoke, said guiding means being aligned at one end thereof with said opening in said supporting means and at its opposite end with said holding means, said magazine being adapted to contain a plurality of flat, rectangular, reinforcing members in stacked relationship and being disposed laterally of the opening in said supporting means, and a dispenser for delivering individual reinforcing members from said magazine and to the opening in said supporting means.

8. Apparatus as defined in claim 7 wherein said magazine includes an opening at its lowermost end, and said dispenser includes a plate disposed between said magazine and said magazine supporting means, and means for reciprocating said plate relative to said magazine for urging an individual rectangular reinforcing member along said magazine supporting means and toward the opening therein.

9. Apparatus as defined in claim 8 wherein the opening in said magazine supporting means is slightly smaller than and is aligned at one end with said magazine opening whereby an individual reinforcing member, upon being urged over the opening in the magazine supporting means, tilts therein by gravity.

10. Apparatus as defined in claim 9 wherein said holding means includes an abutment fixed to said wall along one side of the opening therein, a movable retainer plate disposed along an opposite side of said wall opening and means for moving said retainer plate to and from an operative position in which said retainer plate partially overlaps the opening in said wall, said retainer plate in its operative position cooperating with said abutment to hold a reinforcing member adjacent to said wall opening and in its inoperative position permitting removal of the reinforcing member with the strapped package.

* * * * *